United States Patent [19]

Boujard et al.

[11] 4,104,082

[45] Aug. 1, 1978

[54] LIFTING DEVICE FOR USE IN A LIQUID MEDIUM

[76] Inventors: Claude Boujard, 138 Rue Davis Johnston, 33000 Bordeaux, France; Joseph Vilaldach, 74 Avenue de Verdun, 33200 Bordeaux, France

[21] Appl. No.: 772,024

[22] Filed: Feb. 25, 1977

[30] Foreign Application Priority Data

Feb. 27, 1976 [FR] France ..... 7606058

[51] Int. Cl.[2] ..... B08B 13/00; B63B 21/00

[52] U.S. Cl. ..... 134/141; 134/117; 61/65; 114/45

[58] Field of Search ..... 134/117–120, 134/135, 141; 61/65; 114/45, 263

[56] References Cited

U.S. PATENT DOCUMENTS

| | | | |
|---|---|---|---|
| 2,632,453 | 3/1953 | Friedman | 134/117 X |
| 3,270,698 | 9/1966 | Fort | 114/45 |
| 3,722,223 | 3/1973 | Gratz | 61/65 X |
| 4,027,492 | 6/1977 | Carpenter | 61/65 |

*Primary Examiner*—Robert L. Bleutge

*Attorney, Agent, or Firm*—Brisebois & Kruger

[57] ABSTRACT

A lifting device for raising a platform out of a liquid medium and lowering it back into the liquid medium comprises a tank supporting the platform and connected to a side wall of the space containing the liquid medium through a linkage pivoted to the side wall and to the tank. To raise the platform air is pumped into the tank and to lower it the air is displaced by the liquid medium.

15 Claims, 2 Drawing Figures

LIFTING DEVICE FOR USE IN A LIQUID MEDIUM

Figure 1:
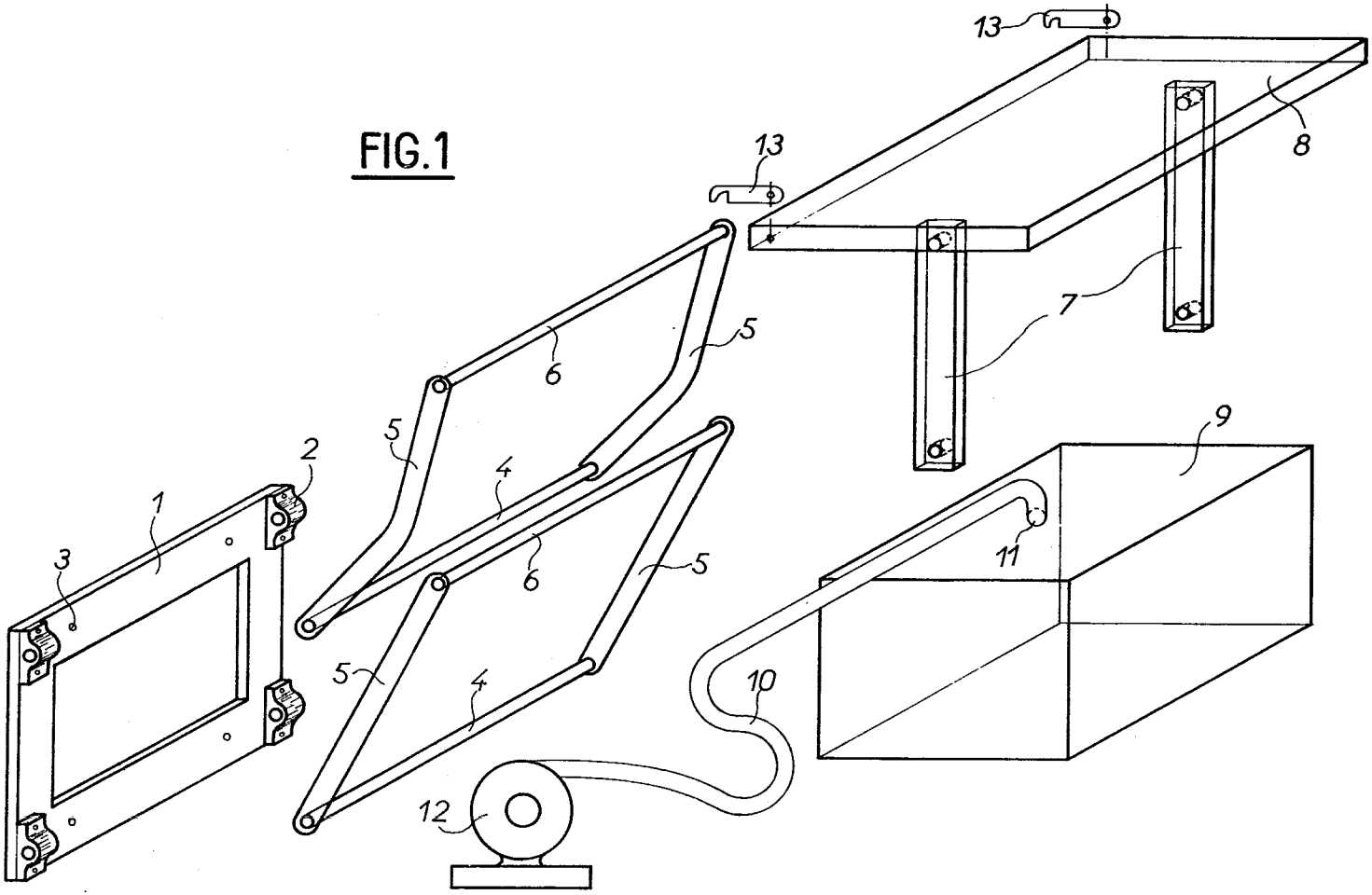

The present invention is concerned with lifting devices which can be used to submerge a load-carrying platform in a liquid medium or to raise the platform out of the liquid medium.

In some forms of prior lifting devices, the platform is raised and lowered mechanically, by means of winches, cables, chains or gears, so that the machinery is complicated and installing and servicing it are difficult and delicate matters. In other forms of prior devices, the platform is raised and lowered hydraulically or pneumatically, the machinery used being complicated and very often unsuited to operation in a liquid medium.

When such machines must be used in a liquid medium, simple leaks can result in faulty operation of the machine or pollution of the liquid medium.

In other forms of machines, the operating mechanisms can be located out of the liquid medium. This requires the provision of means for guiding the platform, and if these are to be effective they must be accurately manufactured and installed. They also tend to make it difficult to gain access to the platform, and are not aesthetically pleasing.

A lifting device according to the present invention, arranged to be mounted on a side wall of a space containing the liquid medium, comprises a tank; a load-carrying surface supported by the tank; first means pivotally mounted with respect to the tank and with respect to the said side wall, the first means comprising a pair of arms, the first ends of the arms being pivotally mounted with respect to the tank for pivotal movement about a first horizontal axis and the second ends of the arms being pivotally mounted with respect to the said side wall for pivotal movement about a second horizontal axis which is parallel to the first horizontal axis; second pivotally mounted means comprising at least one link having one end pivotally mounted with respect to the tank and the other end pivotally mounted with respect to the said side wall; whereby the load-carrying surface can be raised from the liquid by removal of liquid from the tank and can be submerged when the tank is again filled with the liquid.

The second pivotally mounted means may be identical to the first system, to improve the stability of the assembly, or may simply consist of one or more links connecting together two axles, one on the frame and the other on the platform support.

In the preferred device embodying the invention, the second pivotally mounted means comprises a second pair of arms having their first ends mounted for pivotal movement with respect to the tank about a third horizontal axis and their second ends mounted for pivotal movement with respect to the said side wall about a fourth horizontal axis, the four horizontal axes being parallel with one another. In this embodiment, the first ends of each of the pairs of arms are interconnected by an axle passing through a frame to which the tank is connected and the second ends of each of the pairs of arms are interconnected by an axle rotatably mounted on a frame for attachment to the side wall.

Thus, a device embodying the present invention overcomes the above-mentioned disadvantages. Using this device, the platform can be lowered into a liquid medium and raised from it at will, by means of a single pump which can displace all or some of the liquid contained in a tank which supports the platform, by pumping in an equivalent amount of air or of any kind of material which is less dense than the liquid medium.

The device is such that the initial inclination of the platform can be maintained, using a simple parallelogram system, or varied, using a simple system of trapezoids, the parallelograms or trapezoids being deformable.

As the device does not require the use of rails, the platform is readily accessible at all points on its circumference, and the device can be fully integrated with the installation site, from the aesthetic point of view.

In one embodiment of the invention the pivot axes of the arm systems are parallel and equally spaced in pairs, so that, seen in the direction parallel to the axes, they form one or more parallelograms. With this arrangement the initial inclination of the platform is preserved as it moves up and down.

In another embodiment of the invention the four pivot axes of the two arm systems are parallel, but the distances between them are not the same, being determined in accordance with the required change in the inclination of the platform as it is raised and lowered.

The raising and lowering of the platform exploits Archimedes' principle, by changing the contents of a tank located in the liquid medium so that the ratio of the total weight of the movable part of the device, plus the load, to the submerged volume is greater than or less than the density of the liquid medium. The tank supports the platform, or the platform may simply consist of the upper surface of the tank.

In one embodiment of the invention the tank is entirely enclosed. The liquid medium can be admitted to the tank through a valve or pump located in the lower part of the tank. The tank then descends, drawing the platform down into the liquid medium. The liquid is removed from the tank by a pump, and in certain circumstances the same pump may be used to fill and to empty the tank with the liquid. If the pumping system and the design of the tank are such that a vacuum can be created in the tank without its volume being reduced, these two items of equipment are sufficient to produce proper operation of the system. If this condition is not satisfied, excessive pressure rises and drops are minimised by means of a highly compressible body, such as a gas which liquefies at very low pressure, located inside the tank. Alternatively, pressure rises and drops can be eliminated by connecting the upper part of the inside of the tank at all times to atmosphere or to a vessel containing a material which is less dense than the liquid medium, such as oxygen or balls of expanded polystyrene, for example. Once the tank is emptied of liquid, it rises to the surface of the liquid medium, lifting the platform.

In another embodiment of the invention the bottom of the tank is open, and the tank is connected to a pipe so that when the tank is submerged it can be filled with air or other material which is less dense than the liquid medium. This expels the liquid medium from the tank, so that it rises to the surface, lifting the platform. When the pressure in the pipe drops, the liquid medium reenters the tank, driving out the less dense medium, and causes the tank to sink. For example, a turbo-compressor can be used to empty the tank of liquid by pumping in air at a pressure greater than the pressure in the liquid medium at the level of the bottom of the tank. If the pipe is connected to the upper part of the tank, it is only necessary to stop the compressor for the air to be driven out of the tank the same way it was pumped in. A simple valve can be fitted in the pipe-line, for keeping the pressurised air in the tank, if required.

In a further embodiment of the invention, the tank is entirely enclosed, and contains a material which is less dense than the liquid medium, which raises the platform from the liquid. A material which is more dense than the liquid medium is introduced into the tank in order to submerge the platform.

As a safety measure, the device may be mechanically locked in the raised or lowered position.

Figure 2:
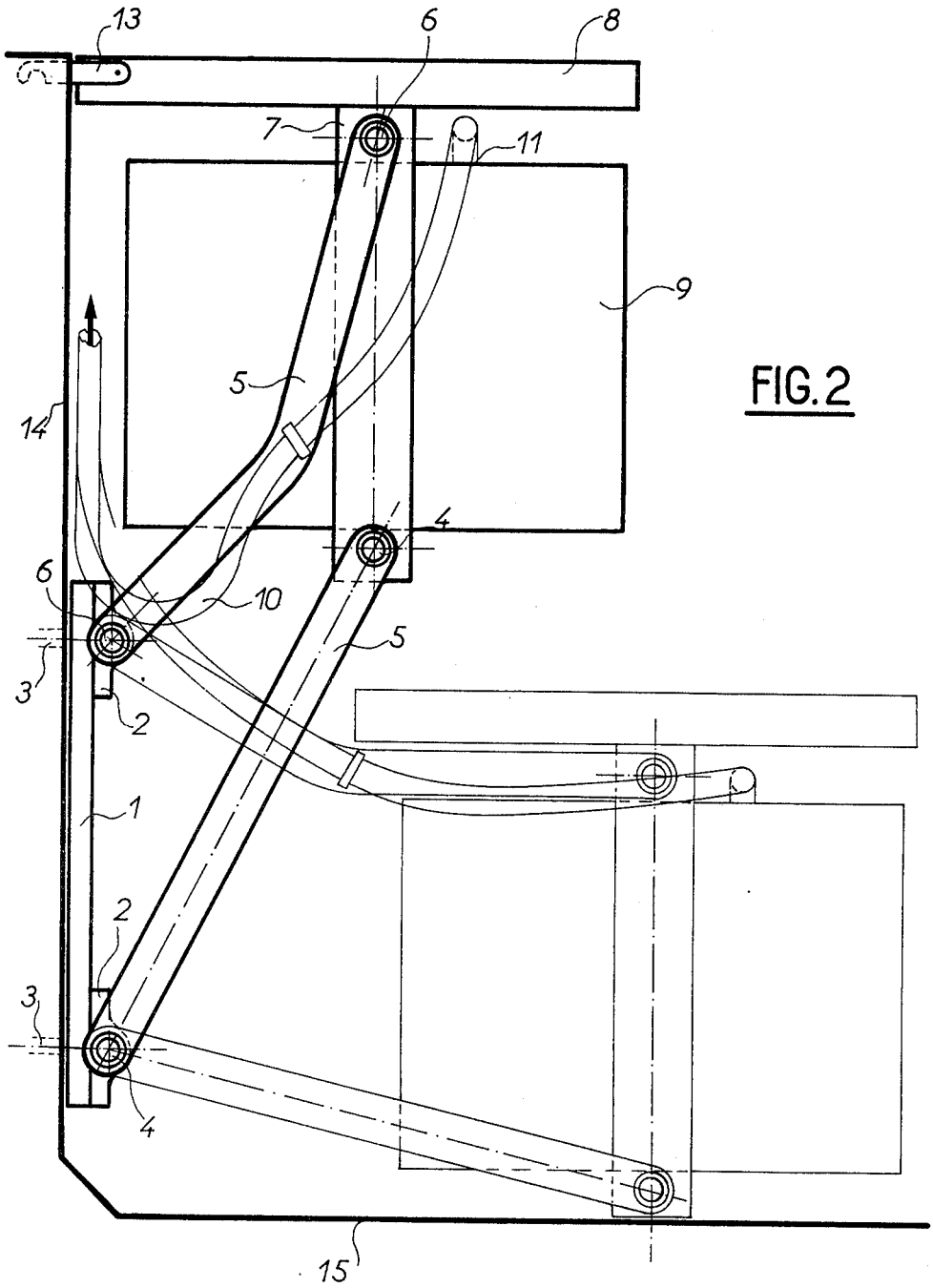

In order that the invention may be better understood, one example of a device embodying the invention will now be described with reference to the accompanying drawings, in which FIG. 1 is an exploded view of parts of the device and FIG. 2 is a side view of the device.

The device comprises a rigid frame 1 to which are attached four bearings 2. The frame 1 has four holes 3, for attaching it to a vertical side wall of the space containing the water, here assumed to be a pool or dock. Two axles 4 pivot in the bearings 2. pairs of arms 5 are welded to the opposite ends of each of the axles 4, and the other ends of the arms 5 are screwed to two other axles 6, which are pivoted to uprights 7 of a platform 8. A bottomless tank or caisson 9 is fitted between the uprights. A flexible pipe 10 connects an opening 11 on the top of the tank to an air compressor 12. Starting the compressor directs air into the tank, which drives out the liquid in the tank so that it rises to the surface of the liquid. Stopping the compressor enables the air to escape from the tank and the liquid to re-enter it, so that it sinks. As shown in FIG. 2, the device can be locked in the raised position by means of two hooks 13 which engage the side wall 14 of the pool or dock. As the axles 4 and 6 are parallel and equidistant in pairs, the platform 8 is kept horizontal, even when moving up and down. In the lowered position the uprights 7 of the platform rest on the bottom 15 of the pool or dock.

The device constituting the object of the invention can be used in all situations in which it is necessary to place on or in a liquid medium and/or to remove from the medium any body, for example, a person, or an animal, or an object, which is difficult or delicate to handle. It may be used at the side of a body of water for putting boats into the water or lifting boats out of the water.

A particularly useful application of the device is enabling physically handicapped persons to get into or out of a bath, swimming pool or other body of water unaided, even if confined to a wheelchair.

We claim:

1. A lifting device for use in a liquid medium, comprising:

a substantially parallelepipedical bottomless tank having an upper wall and submergible in the liquid medium means for introducing air into said tank for driving the liquid out of the tank to raise the tank from the liquid medium and for discharging air from the tank to fill the tank with liquid to lower the tank into the liquid medium; and guide means for guiding the tank with respect to a side wall of a space containing the liquid medium, during the lowering and the raising of the tank, so that the longitudinal axis of said tank remains parallel to the side wall, said guide means comprising a first pair of parallel arms and a second pair of parallel arms, first corresponding ends of the two arms of the first pair of arms being pivotally mounted with respect to said side wall for pivotal movement about a common first horizontal axis, second corresponding ends of said first pair of arms and being pivotally mounted with respect to the tank for pivotal movement about a second common horizontal axis, first corresponding ends of the two arms of the second pair of arms being pivotally mounted with respect to the said side wall for pivotal movement about a common third horizontal common axis, and second corresponding ends of said second pair of arms being pivotally mounted with respect to the tank for pivotal movement about a common fourth horizontal axis, said tank having its length parallel to said axis and the two arms of each pair of arms being spaced apart horizontally at a distance greater than the length of the tank, said fourth axes being parallel, said first and third axes being spaced apart in the plane of said side wall, and said second and fourth axes being spaced the same distance as said first and third axes in a plane containing the longitudinal axis of the tank and perpendicular to the upper wall of the tank.

2. A lifting device as defined in claim 1, wherein the said four arms are parallel and have the same length.

3. A lifting device as defined in claim 1, wherein the two arms of the said first pair of arms have a length different from that of the two arms of the said second pair of arms.

4. A lifting device as defined in claim 1, wherein the plane of said first and third axes and the plane of said second and fourth axes are each vertical.

5. A lifting device according to claim 1, further comprising a mechanical locking device for locking the tank in the raised position.

6. A lifting device for use in a liquid medium, comprising:

a substantially parallelepipedical bottomless tank having an upper wall and submergible in the liquid medium;

means for introducing air into said tank for driving out the liquid from the tank to raise the tank from the liquid medium and for discharging air from the tank to fill the latter with liquid to immerse the tank in the liquid medium, a rectangular platform spaced slightly above the upper wall of the tank in a plane parallel with the upper wall, two parallel uprights respectively on opposite sides of and secured to said tank, said uprights having a length greater than the height of the tank, said uprights extending downwardly from and being secured to said platform so that the platform is secured to said tank, and guide means for guiding the tank with respect to a side wall of a space containing the liquid medium, during the lowering and the raising of the tank, so that the longitudinal axis of said tank remains parallel to the side wall, said guide means comprising a first pair of parallel arms and a second pair of parallel arms, first corresponding ends of the two arms of the first pair of arms being pivotally mounted with respect to the said side wall for pivotal movement about a first common horizontal axis, and second corresponding end of said first pair to the uprights for pivotal movement about a common second horizontal axis, first corresponding ends of the two arms of the second pair of arms being pivotally mounted with respect to the said side wall for pivotal movement about a common third horizontal axis, and second corresponding ends of said second arms being pivotally connected to the uprights for pivotal movement about a common fourth horizontal axis, the two arms of each pair of arms being spaced horizontally at a distance greater than the length of the tank, said four axes being parallel, said first and third axes being spaced in the plane of said side wall and said second and fourth axes being spaced at the same distance as said first and third axes in a plane containing the longitudinal axis of the tank and perpendicular to the upper wall of the tank.

7. A lifting device as defined in claim 6, wherein the two arms of the first pair of arms and the two arms of the second pair of arms are rigidly secured to axles corresponding to the respective axes.

8. A lifting device as defined in claim 6, wherein the common plane of the two uprights is between the planes of the two opposite longitudinal side walls of the tank, and said pairs of arms are each outwardly of the side of the uprights so that the tank can move to a position adjacent the side wall.

9. A lifting device as defined in claim 6, wherein the common plane of the two uprights contains the longitudinal axis of the tank.

10. A lifting device as defined in claim 6, wherein the platform extends beyond the side edges of the upper wall of the tank and the two arms of the said first pair of arms are bent upwardly.

11. A lifting device as defined in claim 6, wherein the four arms have the same length.

12. A lifting device as defined in claim 6, wherein the two arms of the said first pair of arms have a length different from that of the two arms of the said second pair of arms.

13. A lifting device as defined in claim 6, wherein the common plane of said first and third axes and the common plane of said second and fourth axes are vertical.

14. A lifting device as defined in claim 6, further comprising a mechanical locking device for locking the platform in the raised position.

15. A lifting device as defined in claim 6, wherein said first and third axes are each substantially below the normal water level so that the arms are included substantially upwardly when the tank is raised and support a portion of the weight of the tank when the locking device is locked.

* * * * *